United States Patent [19]

Guadnola

[11] Patent Number: 4,730,863

[45] Date of Patent: Mar. 15, 1988

[54] APPARATUS FOR CARRYING CLOTHING SUSPENDED ON A COAT HANGER

[76] Inventor: James A. Guadnola, 1272 - 16½ Rd., Fruita, Colo. 81521

[21] Appl. No.: 919,062

[22] Filed: Oct. 14, 1986

[51] Int. Cl.[4] ..... A45C 13/26; B65D 69/00

[52] U.S. Cl. ..... 294/156; 294/142; 294/167

[58] Field of Search ..... 294/137, 141–143, 294/147–150, 152–154, 156, 157, 164–167, 170

[56] References Cited

U.S. PATENT DOCUMENTS

| | | | |
|---|---|---|---|
| 882,722 | 3/1908 | Stark | 294/150 X |
| 2,629,529 | 2/1953 | Threeton | 294/143 |
| 3,584,772 | 6/1971 | Robertson | 294/142 |
| 4,091,976 | 5/1978 | Morse | 294/142 |
| 4,153,189 | 5/1979 | Hughes | 294/143 |
| 4,284,219 | 8/1981 | Standel | 294/152 |

FOREIGN PATENT DOCUMENTS

| | | | |
|---|---|---|---|
| 173557 | 7/1906 | Fed. Rep. of Germany | 294/156 |
| 677353 | 6/1939 | Fed. Rep. of Germany | 294/150 |
| 2501996 | 9/1975 | Fed. Rep. of Germany | 294/147 |

*Primary Examiner*—Johnny D. Cherry
*Attorney, Agent, or Firm*—Hughes & Cassidy

[57] ABSTRACT

Carrying apparatus for engaging a hook portion of a hanger to aid in carrying garments supported on the hanger. The carrying apparatus includes a handle having a cord inserted through a vertical hole in the handle; the hole extending in a direction perpendicular to the handle lengthwise axis. The cord includes a looped end portion for engaging the hanger hook to suspend the hanger from the hook when being carried. When not being carried, the cord is pulled upwardly through the handle hole so that the loop is partially engaged within the handle hole and is tightened around the hanger hook. The cord is secured within a slotted portion of the handle to secure the loop tightly around the hanger hook.

9 Claims, 12 Drawing Figures

FIG. 1
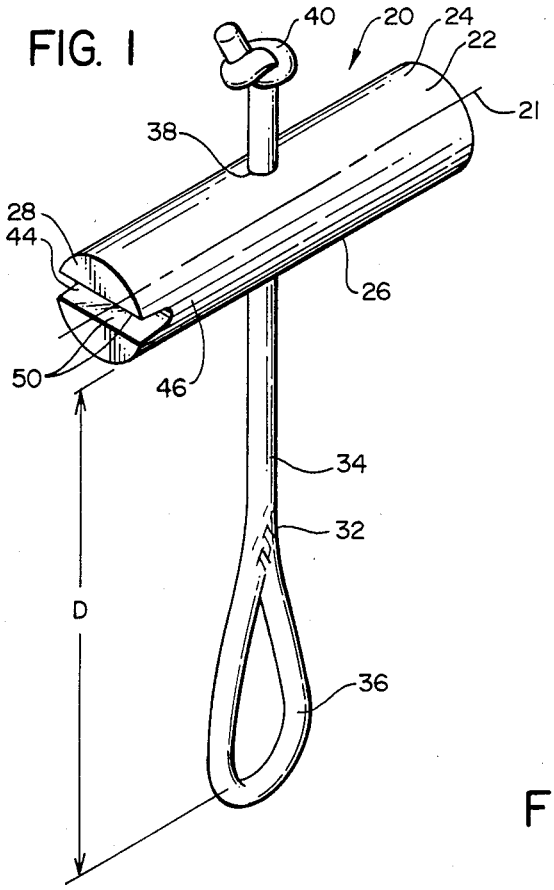
FIG. 2
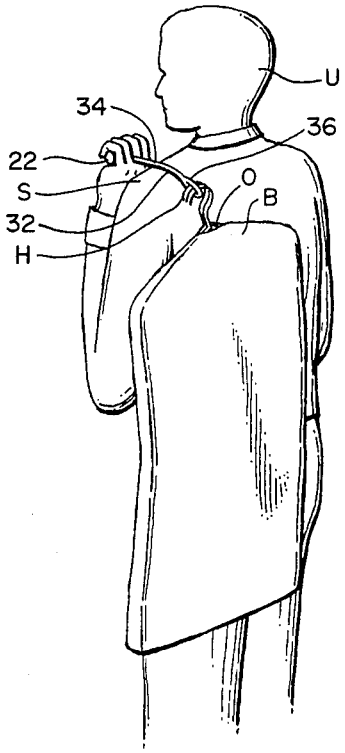
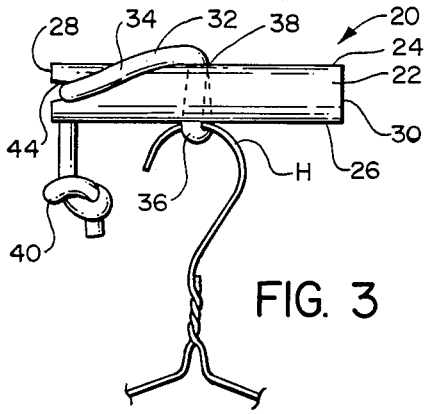
FIG. 3
FIG. 4
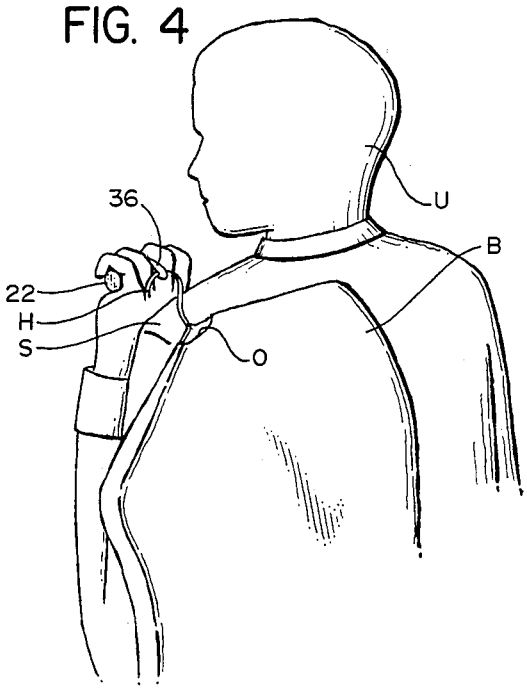

APPARATUS FOR CARRYING CLOTHING SUSPENDED ON A COAT HANGER

TECHNICAL FIELD

The present invention pertains to an apparatus for engaging the hook of a coat hanger to facilitate the carrying of clothing which is suspended on the coat hanger.

BACKGROUND OF THE INVENTION

It is a common practice to carry clothing which is suspended on one or more conventional hangers by grasping the hooked end of the hanger with the fingers and holding the hanger at a sufficient height to avoid dragging the clothing across the ground. If it is necessary to walk any significant distance, this manner of carrying the coat hanger and clothing can be uncomfortable. It is a common practice, particularly among travelers at airports, to carry clothing contained in garment bags by grasping the hooks of the coat hangers in front of the body while draping the garment bag over the shoulder and across the back. This manner of carrying clothing also may become uncomfortable because the wire frames of the hooks tend to dig into the flesh of the fingers causing fatigue and soreness.

A further problem results when the garment bag is no longer being carried and is set on the ground, such as when waiting to board an airplane. It is not uncommon for the weight of the garments to cause one or more of the hooks to slip down inside the garment bag. Thus when it comes time to again carry the bag, it is necessary for the user to open the garment bag and reinsert the hanger hook upward through the opening in the garment bag.

A number of apparatus for suspending or carrying coat hangers have been disclosed. For instance, in U.S. Pat. No. 2,355,705 by Cohn, there is disclosed a coat hanger suspension device having a number of end-to-end loops which form a cordlike structure having balls mounted at opposite ends of the cord. The combination of the loops and balls act to suspend a hanger which does not have a hook.

Hooker, in U.S. Pat. No. 3,313,460 discloses a device for carrying one or more coat hangers including an oval handle to which there is slidably mounted a first ring which is connected by a shaft to a second ring for receiving the hooks of one or more coat hangers.

In U.S. Pat. No. 3,712,525 by McFarland, there is disclosed a suitbag carrier including a handle to which is swivelly mounted a flange having a plurality of holes for receiving the hooks of wire coat hangers.

Eason, in U.S. Pat. No. 3,112,050 discloses a plastic handle covering for the wire hook of a clothes hanger.

A clothes hanger assembly is disclosed in U.S. Pat. No. 3,731,809 by Sanger which includes an upper hooked portion which is adapted to be placed over a conventional support bar and a lower flanged portion having a plurality of slots for receiving clothes hanger hooks.

There is disclosed by Hill in U.S. Pat. No. 3,848,787, a tubelike device for carrying hanging bags, including a curved bar which is supported across the shoulder and which extends forward of the user to form a handle portion, and a rearward portion which includes a number of openings for receiving hanger hooks therein.

A device for carrying hangers is disclosed in U.S. Pat. No. 3,961,734 by Threeton, Sr., and which includes an upper hook-like carrying handle and a lower portion having slots for receiving hanger hooks.

Also in Dock, U.S. Pat. No. 4,288,012, there is disclosed a one piece carrying handle for a number of coat hangers including a housing having a handle portion and a slotted curved portion for supporting a number of the hanger hooks.

Finally in U.S. Pat. No. 4,342,479 by Hofer, there is disclosed a hanging bag device for a garment bag including a hooked member having a downwardly extending shaft about which is swivelly mounted a contoured carrying handle.

SUMMARY OF THE INVENTION

The present invention pertains to an apparatus for carrying clothing which is suspended on one or more hangers. More specifically, the apparatus is for carrying clothing which is supported on a hanger having a lower clothing suspension portion and an upper hook portion. The apparatus includes a handle having a first upper surface, a second lower surface, a hole which extends between the first surface and the second surface, and first means for retaining the cord in the handle. Also included are cord means which includes a first portion which is located above the handle first surface and a second portion which extends through the handle hole and which is slidably engaged within the handle hole. The cord first portion has cord second retaining means for retaining the cord means within the handle hole. The cord means also includes a second portion having a looped end for receiving the hanger hook portion. The carrying apparatus has two operational modes, including a first carrying mode in which the upper hook portion is inserted through the loop and the handle is grasped by the user in a manner to suspend the hanger and clothing thereon. In this manner, the loop is disengaged from the hole. The carrying apparatus also has a second non-carrying mode in which the apparatus is secured to the hanger by i) engagement of the loop within the handle hole so as to tighten the loop about the hanger hook, and ii) releasable engagement of the cord first portion to the cord first retaining means in a manner to retain the loop in the handle hole.

It is therefore an object of the present invention to provide a garment carrier for engaging the hooked portion of a hanger to facilitate carrying the hanger and clothing suspended thereon.

BRIEF DESCRIPTION OF THE DRAWINGS

These and other objects of the present invention will become more readily apparent upon reading the following Detailed Description and upon reference to the attached Drawings in which:

FIG. 1 is an isometric view of a first embodiment of the garment carrier of the present invention in an unsecured mode;

FIG. 2 is an environmental view showing the first embodiment in the unsecured mode for carrying garments by engaging the hooks of coat hangers;

FIG. 3 is a front elevational view of the first embodiment in a first secured mode;

FIG. 4 is an environmental view of the first embodiment in the first secured mode for carrying garments;

Figure 5A:
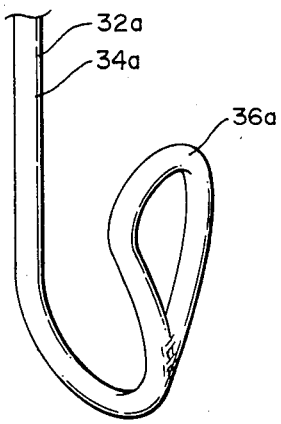
FIGS. 5A, 5B, and 5C show a second embodiment of the present invention in which a slip knot is used for securing the coat hanger hooks in a second secured mode.

While the present invention is susceptible to various modifications and alternative forms, specific embodiments thereof have been shown by way of example in the Drawings and will herein be described in detail. It should be understood, however, that it is not intended to limit the invention to the particular forms disclosed, but on the contrary, the intention is to cover all modifications, equivalents and alternatives falling within the spirit and scope of the invention as expressed in the appended claims.

DETAILED DESCRIPTION

The present invention pertains to apparatus for engaging the hook of a garment hanger to facilitate the carrying of clothing supported on the hanger.

Referring now to FIG. 1, there is shown a first embodiment of a hanger carrier, generally indicated at 20, and including a cylindrical handle 22 with a lengthwise axis designated by the number 21, and having an upper surface 24, a lower surface 26, a left planar end face 28, and a right planar end face 30 (FIG. 3); the handle 22 being made of a somewhat rigid material such as wood, plastic, rubber or the like. The hanger carrier 20 also includes a support cord 32 which in the present embodiment has a linear portion 34 and which terminates at its lower end in a loop 36; the cord 32 being made of a flexible material such as nylon, leather, or the like. The support cord 32 is slidably engaged within a hole 38 which extends vertically between the upper surface 24 and the lower surface 26 in a manner perpendicular to handle lengthwise axis 21. The cord 32 includes a knot 40 or similar device having a greater width dimension than hole 38 at its upper end which engages handle upper surface 24 to retain the cord 32 in the handle. In order to hide the knot 40 from view, the upper surface 24 may include a recessed concave portion (not shown) around the hole 38 within which the knot 40 is engaged when the carrier is being used as shown in FIG. 2.

Referring now to FIG. 2, there is shown a user U carrying a garment bag B by means of the carrier 20. The garment bag B contains clothing (not shown) which is suspended on hangers having hooks H which extend upwardly through an opening O in the top of the garment bag. In order to carry the garment bag, the hooks H are inserted through the loop 36. In order to more fully explain the present invention, there is described an exemplary mode for carrying clothing by means of carrier 20. The clothing is typically carried by the user 20 in a manner that the user's fingers grasp the handle 22 in front of the user's shoulder S. In addition, the cord linear portion 34 extends rearward through the user's fingers and across the shoulder S so that the loop 36 extends in a somewhat downward direction across the user's back. In this position, with the hooked portions H engaged through the loop 36, the majority of the weight of the garments are supported across the user's shoulder S. To accomplish this, a distance D of cord 32 (FIG. 1), measured from the lower end of the loop 36 to the lower surface 26 of the handle 22, is sufficient to permit the loop to extend across the shoulder and in a somewhat downward direction across the user's back as shown in FIG. 2. To achieve this, typically distance D is from about four to about eight inches. It can be appreciated that when the garments are carried in this manner, there is a rearward force exerted via the handle to the user's hand and arm. However, this force is opposed by the user's upper arm and shoulder, thus significantly reducing the load supported by the user's hand and arm muscles. In the unsecured carrying mode shown in FIG. 2, the hooks H remain in the loop 36 due to the downward force exerted by the weight of the clothing and garment bag B. It, however, may be desirable to use the carrier 20 to carry the hangers and clothing suspended in front of the body in which case the distance D of cord 36 would be less than described above to avoid dragging the clothing across the ground.

To prevent the support cord 32 from slipping off the hook H when the garments are not being carried, the carrier 20 is secured to the hanger hooks H. To accomplish this, the handle left end face 28 includes a slot 44 which extends across end face 28 between a front surface 46 and a rear surface (not shown) of the handle in a direction generally perpendicular to both the lengthwise axis of the hole 38 and the lengthwise axis 21 of handle 22. When the hangers are not being carried, the support cord 32 is pulled upwardly until the loop 36 is partially engaged within the vertical hole 38 as shown in FIG. 3. This is achieved by the fact that the cord portions which formed the loop 36 have a combined diameter which is smaller than the diameter of the hole 38. Thus when the cord portions are pulled into the hole 38, the inner circumference of the loop is effectively decreased, causing the loop to close about the hanger hooks H and pulling the hook H against the handle lower surface 26. This not only secures the carrier 20 to the hanger hooks 20 so it is readily available when needed to carry the garments again, but it also prevents the hooks from slipping downward through the opening O. To hold the support cord 32 in the first "secured" position so that the loop 36 remains bound about the hanger hooks H, as shown in FIG. 3, the upper portion of the cord which extends above handle upper surface 22 is inserted into the retaining slot 44. Opposing sidewalls 50 of slot 44 converge so that a vertical distance between them is less than the diameter of cord 32, thus permitting the cord to be wedged within the slot 44. To further aid in retaining the cord within the slot 44, the sidewalls have teeth (not shown) which engage the cord within the slot. Furthermore, the slot 44 has a lengthwise axis which is perpendicular to the lengthwise axis of vertical hole 38. Thus when cord 32 is secured within slot 44, it bends across the forward surface 46 at a 90° angle from the hole 38, and then around to the handle end face 28 and along slot 44 at an angle of 90° to front surface 46. When it is desired to again carry the garment bag by the carrier 20, the cord 32 is removed from the slot, and the bag is lifted by the handle 22 so that the knot 40 once again engages the handle upper surface 24, and the bag is placed in a carrying position such as the one shown in FIG. 2.

In the present embodiment, an exemplary manner of utilizing the carrier 20 of the present invention is shown with the garment bag B carried across the user's back, and with the support cord 32 extending across the user's shoulder. However, it should be appreciated that in the present invention there are other modes of carrying clothing utilizing carrier 20 as long as the loop 36 extends in a somewhat downward direction so that the weight of the clothing and garment bag holds the hooks H within the loop 36.

It should be appreciated that the clothing may be carried by the user U, as shown in FIG. 4, when the carrier 20 is in the aforementioned first secured position. In this manner, the hooks H are securely bound to the carrier when the bag is being carried. The handle 22 is grasped so that the loop 36 extends between the user's fingers, and the fingers are separated somewhat from the loop 36 to fit between the handle 22 and the hooks H. Although this manner of carrying the bag B does not permit a majority of the weight of the garment bag to be supported across the user's shoulder as when the cord is secured as shown in FIG. 2, it permits the hooks to remain bound together at all times and eliminates the need to engage and disengage the cord 32 from the slot 44.

Figure 5B:
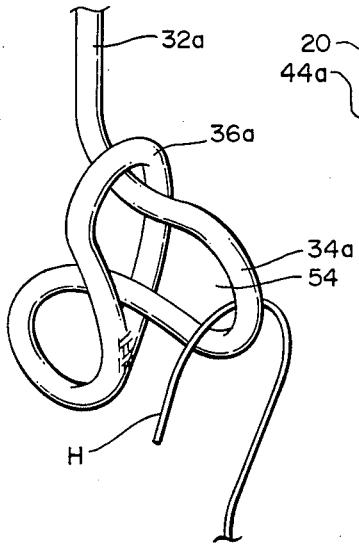
Figure 5C:
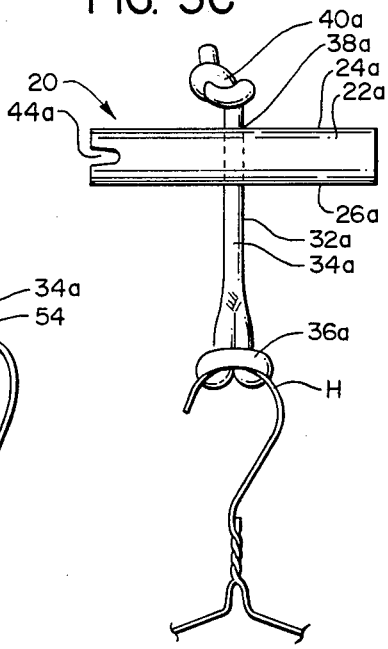
Figure 6:
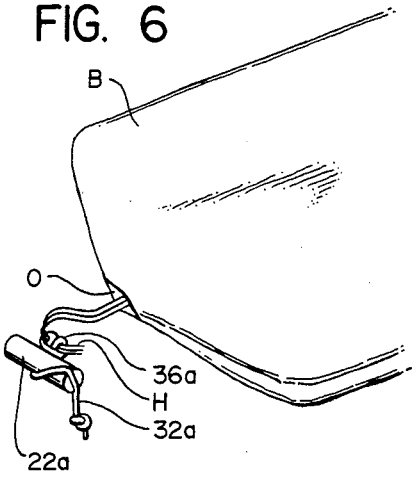
FIG. 6 is an environmental view showing the second embodiment in a third secured mode.
Figure 7:
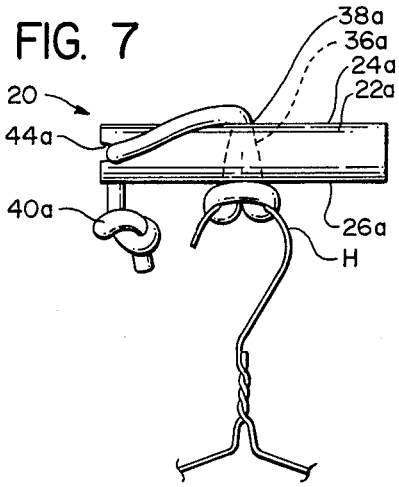
FIG. 7 is a side elevational view showing the position of the slip knot in the third secured mode.

In order to secure the carrier to the hooks H when the garments are being carried, a second embodiment of the present invention is shown in FIGS. 5A through 5C; like elements described in the previous embodiment being identified by like numerals with the suffix "a" attached. In the present invention, the second embodiment is identical to the first embodiment, except that the cord linear portion **34*a* is inserted through the loop 36*a* to form a slip loop 54 which forms a slip knot when tightened. The hanger hook H is inserted through the loop 54, and the downward weight of the clothing and garment bag when being carried, causes the loop 54 to close, thus binding the hanger hooks H. When the downward weight of the clothing and garment bag are removed, such as when the garment bag is set on the floor as shown in FIG. 6, the cord 32*a* is pulled upwardly so that the cord portions that form the loop 36*a* are partially engaged within the vertical hole 38*a* as shown in FIG. 7, and the cord upper portion is inserted in slot 44*a*. In this manner, a portion of loop 36*a* is held firmly against the handle lower surface 26*a* so that the slip loop 54** remains tightened around the hooks H.

Figure 8:
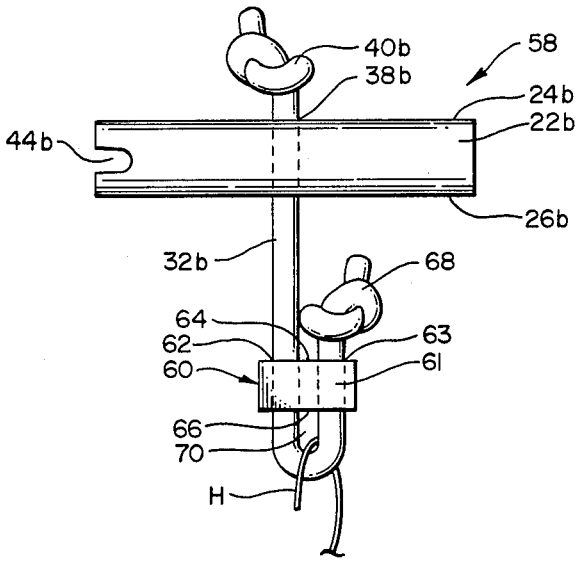
FIG. 8 is a side elevational view of a third embodiment of the present invention.

In a third embodiment of the present invention, in which like elements described in previous embodiments are shown by like numerals with the suffix "b" attached, there is shown in FIG. 8 a carrier indicated at 58 which is identical to the carrier 20 of the first embodiment except that a loop is formed by a slide clasp indicated at 60. The slide clasp 60 has a rectangular configuration with a pair of planar vertical sides 61 so as to lie comfortably across the user's back when the garments are being carried, and a pair of adjacent vertical holes 62, 63 which extend between the upper and lower horizontal planar surfaces 64, 66 of the slide clasp. The support cord **32*b* extends downwardly through the hole 62 and then back upwardly through the hole 63, terminating in a knot 68. The portion of the cord 32 which extends below lower surface 66 forms a loop 70 through which hanger hook H is inserted. When the clothing is being carried by handle 22*b*, the knot 68 bears against the clasp upper surface 64 and the cord portion which forms the loop 70 is bound securely about the hanger hook H. When not being carried, the carrier 58 may be placed in a secured position where the loop 70 is secured tightly about hanger hook H, knot 68 is held against handle lower surface 26*b*, and the upper portion of cord 32*b* is retained within slot 44*b***.

Figure 10:
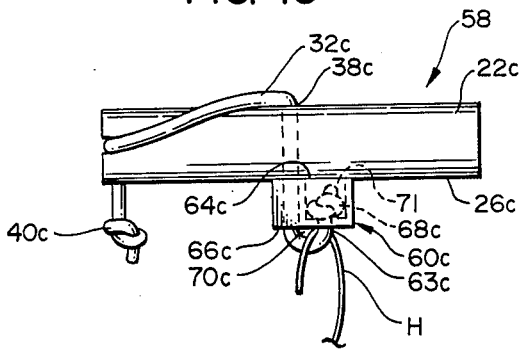
FIG. 10 is a side elevational view of a fourth embodiment of the present invention.

In a fourth embodiment, shown in FIG. 10, like elements described in the previous embodiments are designated by like numerals with a "c" suffix attached. In the present embodiment, clasp **60*c* includes a recessed cavity 71 in the upper surface 64*c* above the vertical hole 63*c* to received the knot 68*c* therein. The knot 68*c* is located below upper surface 63*c* so that when the carrier is in the secured position shown in FIG. 10, the upper clasp surface 63*c* is pulled adjacent to the handle lower surface 26*c* and loop 70*c*** is pulled tightly around hook H.

Figure 9:
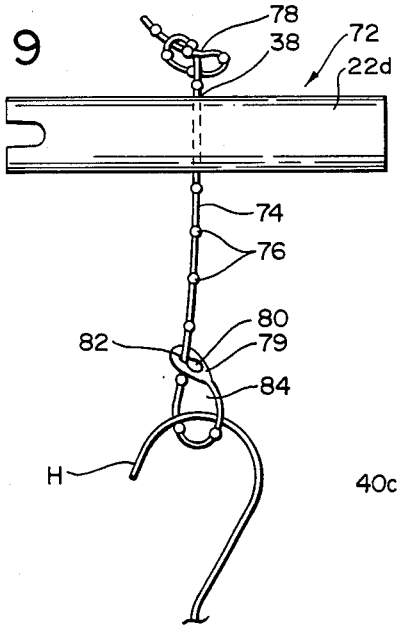
FIG. 9 is a side elevational view of a fifth embodiment of the present invention.

In a fifth embodiment of the present invention there is shown in FIG. 9 a carrier generally indicated at 72 in which elements described in previous embodiments are designated by like numerals with the suffix "d" attached. In the present embodiment the carrier 72 includes a support cord 74 made of a resilient material such as plastic, and which has a number of balls 76 spaced apart along the lengthwise dimension of the cord 74. At the upper end of the support cord 74 is a knot 78 to retain the support cord on the handle **22*d*. At the lower end of the support cord 74 is a fastener 79 which includes a first opening 80 having a circumference which is greater than the circumference of the balls 76, and which communicates with a second opening 82 which has a circumference which is smaller than the balls 76. A loop 84 is formed by the lower end of cord 74 which bends upwardly so that fastener opening 80 is engaged about support cord 74. In order to tighten the loop 84 around the hanger hook H, the balls 76 are manually fed through the larger opening 80, with the fastener 79 being moved downward toward the lower end of the support cord 74, until the loop is tightened sufficiently. Then the loop is secured about the handle hook by moving the cord 74 into the smaller opening 82. The inherent resilience of the cord forming the loop 84 causes the fastener to be engaged against the upper adjacent ball 76 to aid in retaining the cord within the smaller opening 82**.

In the present embodiment, handle **22*d* does not have a slot 44 as in previous embodiments because the cord 74 remains bound about the hook H when not being carried by the fastener 79**.

What is claimed is:

1. Apparatus for carrying clothing which is supported on a hanger having a lower clothing suspension portion and an upper hook portion, the apparatus comprising:

a. a handle having a first upper surface, a second lower surface, a hole which extends between said first surface and said second surface, and cord first retaining means;

b. cord means including i) a first portion which is located above said handle first surface, ii) a second portion which extends through said handle hole and which is slidably engaged within said handle hole, said cord first portion having cord second retaining means for preventing withdrawal of said cord means from said handle hole, and iii) a third portion having a looped end portion for receiving the hanger hook portion therethrough; and c. said carrying apparatus being arranged so as to be able to have two operational modes including (1) a first mode in which said upper hook portion is inserted through said looped end portion and said handle is grasped by a user in a manner to suspend said hanger and clothing thereon, said looped end portion being disengaged from said hole, and (2) a second mode in which said apparatus is secured to said hanger by i) engagement of said looped end portion within said handle hole so as to tighten said looped end portion about said upper hook portion, and ii) releasable engagement of said cord first portion to said cord first retaining means in a manner to retain said looped end portion in said handle hole.

2. The carrying apparatus as set forth in claim 1 wherein:

a. said cord first portion has a first lengthwise dimension when the carrier is in the first mode, and a second lengthwise dimension which is greater than the first lengthwise dimension when the carrier is in the second mode; and b. said cord first portion is secured to said cord first retaining means when said carrier is in said second mode in a manner to maintain said second lengthwise dimension of said cord first portion.

3. The carrying apparatus as set forth in claim 2 wherein:

a. said cord first retaining means includes a slotted portion of said handle; and b. said cord first portion is releasably engaged within said slotted portion in the second mode.

4. The carrying apparatus as set forth in claim 2 wherein said looped end portion includes first and second loop portions which have a combined thickness dimension which is less than a diameter of said handle hole so as to permit said first and second loop portions to be engaged within said handle hole when said carrier is in said second mode so as to tighten said looped end portion about said hanger hook portion.

5. The carrying apparatus as set forth in claim 1 wherein said cord third portion has a sufficient lengthwise dimension so that when said carrier is in said first mode and said handle is held in front of the user, and the clothing is supported across a back portion of the user, said cord third portion extends across and engages a shoulder portion of the user to support a portion of the weight of the clothing and hanger thereon.

6. The carrying apparatus as set forth in claim 5 wherein:

a. said handle has an elongated configuration with a first lengthwise axis; and b. said cord third portion has a second lengthwise axis which is generally perpendicular to said handle lengthwise axis when the carrier is in the first mode.

7. The carrying apparatus as set forth in claim 1 wherein said looped end portion includes a slip loop which is formed by a portion of said cord third portion being inserted through said looped end portion so that said slip loop is defined by said looped end portion and said third portion to tightly engage said hanger hook portion.

8. The carrying apparatus as set forth in claim 1 wherein said looped end portion includes a tightening member having a first surface, an opposing second surface, and first and second tightening member holes which extend between said first surface and said second surface, said third cord portion extending downwardly through said first tightening member hole below said second surface and back upwardly through said second tightening member hole to form said looped end portion for receiving said upper hook portion therethrough, said cord third portion extending upwardly through said second tightening member hole and terminating in third retaining means for retaining said third cord portion within said second tightening member opening, said hook portion being tightened within said looped end portion when in the first mode by an upward carrying force exerted by said user which causes the circumference of said looped end portion to decrease.

9. The carrying apparatus as set forth in claim 1 wherein:

a. said cord third portion includes a plurality of engaging members spaced apart along said cord third portion and each having a greater thickness dimension than said cord third portion;

b. said cord third portion includes i) a fastener which is located at a lower end of said third portion, and which has a first fastener hole having a first diameter which is greater than said thickness dimension of said engaging members, and ii) a second fastener hole, in communication with said first fastener hole, which has a diameter which is less than said thickness dimension of said engaging members; and c. said fastener extends upwardly so that said first fastener hole is slidably engaged about said cord third portion to form said looped end portion for engaging said hanger hook portion, said looped end portion being tightened about said hanger hook by selected placement of said fastener downward toward said lower end and by insertion of said cord third portion within said second fastener opening so that said fastener engages an adjacent one of said engaging members.

* * * * *